US009126394B2

(12) United States Patent
Gullentops et al.

(10) Patent No.: US 9,126,394 B2
(45) Date of Patent: Sep. 8, 2015

(54) METHOD OF PREPARING A FLEXOGRAPHIC PRINTING MASTER

(75) Inventors: Chris Gullentops, Kessel-Lo (BE); Eddie R. Daems, Herentals (BE); Luc Vanmaele, Lochristi (BE)

(73) Assignee: Agfa Graphics NV, Mortsel (BE)

( * ) Notice: Subject to any disclaimer, the term of this patent is extended or adjusted under 35 U.S.C. 154(b) by 205 days.

(21) Appl. No.: 13/698,087

(22) PCT Filed: May 17, 2011

(86) PCT No.: PCT/EP2011/057946

§ 371 (c)(1), (2), (4) Date: Nov. 15, 2012

(87) PCT Pub. No.: WO2011/144596

PCT Pub. Date: Nov. 24, 2011

(65) Prior Publication Data

US 2013/0059089 A1 Mar. 7, 2013

Related U.S. Application Data

(60) Provisional application No. 61/346,475, filed on May 20, 2010.

(30) Foreign Application Priority Data

May 18, 2010 (EP) ..... 10163064

(51) Int. Cl.
*B41C 1/18* (2006.01)
*B41C 1/00* (2006.01)

(52) U.S. Cl.
CPC ..... *B41C 1/003* (2013.01); *B41C 1/182* (2013.01)

(58) Field of Classification Search
None
See application file for complete search history.

(56) References Cited

U.S. PATENT DOCUMENTS

2008/0062214 A1 * 3/2008 Silverbrook ..... 347/10
2009/0197013 A1 8/2009 Gouch et al.

FOREIGN PATENT DOCUMENTS

EP 1 428 666 A1 6/2004
EP 1428666 A1 * 6/2004 ..... B41J 3/407
EP 2 033 778 A1 3/2009
EP 2 033 779 A1 3/2009
EP 2 199 066 A1 6/2010

OTHER PUBLICATIONS

Official Communication issued in International Patent Application No. PCT/EP2011/057946, mailed on Jul. 19, 2011.

* cited by examiner

*Primary Examiner* — Kelly M Gambetta
*Assistant Examiner* — Michael P Rodriguez
(74) *Attorney, Agent, or Firm* — Keating & Bennett, LLP

(57) ABSTRACT

A method of preparing a flexographic printing master including an optional elastomeric floor, an optional mesa relief, and an image relief are applied in this order on a flexographic printing support includes applying and curing fluid droplets thereby building up a plurality of layers of fluid on top of each other, wherein each fluid droplet applied is at least partially cured before an adjacent fluid droplet is subsequently applied, with the exception that a fluid droplet applied during building up at least one layer of fluid is not cured before an adjacent fluid droplet of the same layer is subsequently applied.

14 Claims, 3 Drawing Sheets

METHOD OF PREPARING A FLEXOGRAPHIC PRINTING MASTER

CROSS-REFERENCE TO RELATED APPLICATIONS

This application is a 371 National Stage Application of PCT/EP2011/057946, filed May 17, 2011. This application claims the benefit of U.S. Provisional Application No. 61/346,475, filed May 20, 2010, which is incorporated by reference herein in its entirety. In addition, this application claims the benefit of European Application No. 10163064.8, filed May 18, 2010, which is also incorporated by reference herein in its entirety.

BACKGROUND OF THE INVENTION

1. Field of the Invention

The present invention relates to a method of making a flexographic printing master by inkjet.

2. Description of the Related Art

Flexography is today one of the most important printing techniques and is commonly used for high-volume runs. Flexography is used for printing on a variety of substrates such as paper, paperboard stock, corrugated board, films, foils and laminates. Coarse surfaces and stretch films can only be economically printed with flexography, making it indeed very appropriate for packaging material printing.

Today flexographic printing masters are prepared by both analogue and digital imaging techniques. Analogue imaging typically uses a film mask through which a flexographic printing precursor is exposed. Digital imaging techniques include:

- Direct laser engraving as disclosed in e.g. EP-As 1710093 and 1936438;
- UV exposure through a LAMS mask wherein LAMS stands for Laser Ablative Mask System as disclosed in e.g. EP-A 1170121;
- Direct UV or violet exposure by laser or LED as disclosed in e.g. U.S. Pat. No. 6,806,018; and
- Inkjet printing as disclosed in e.g. EP-As 1428666 and 1637322.

EP-A 1428666 discloses a method of making a flexographic printing master by means of jetting subsequent layers of a curable fluid on a flexographic support. Before jetting the following layer, the previous layer is immobilized by a curing step.

U.S. Pat. No. 6,520,084 also discloses a method of preparing flexographic printing masters using inkjet. In this method, a removable filler material is used to support the relief image being printed and the relief image is grown in inverted orientation on a substrate. Disadvantages of this method are the removal of the filler material and the release of the relief image from the substrate. In U.S. Pat. No. 7,036,430 a flexographic printing master is prepared by inkjet wherein each layer of ink is first jetted and partially cured on a blanket whereupon each such layer is then transferred to a substrate having an elastomeric floor, thereby building up the relief image layer by layer. US20080053326 discloses a method of making a flexographic printing master by inkjet wherein successive layers of a polymer are applied to a specific optimized substrate. In US20090197013, also disclosing an inkjet method of making a flexographic printing master, curing means are provided to additionally cure, for example, the side surfaces of the image relief being formed.

The major advantage of an inkjet method for preparing a flexographic printing master is an improved sustainability due to the absence of any processing steps and the consumption of no more material as necessary to form a suitable relief image (i.e. removal of material in the non printing areas is no longer required).

A problem however that may occur with these inkjet methods is the lack of smoothness of the at least partially cured layers of fluid. Such lack of smoothness may be passed on from layer to layer forming the relief image or may even be reinforced as more layers are jetted on top each other and may result in an unsmooth printing surface of the relief, which can give rise to several printing artifacts such as a deficient reproduction of highlight dots or a deficient rendering of solids. For optimal printing performance, it is required that flexographic printing masters have a relief image with a printing surface that is sufficiently flat or even.

SUMMARY OF THE INVENTION

In order to overcome the problems described above, preferred embodiments of the present invention provide an inkjet method of preparing a flexographic printing master wherein the obtained flexographic printing master is characterized by a sufficiently flat or even printing surface so as to obtain optimal printing properties.

A preferred embodiment of the present invention is achieved by a method of preparing a flexographic printing master as defined below. Further preferred embodiments of that method are also described below.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
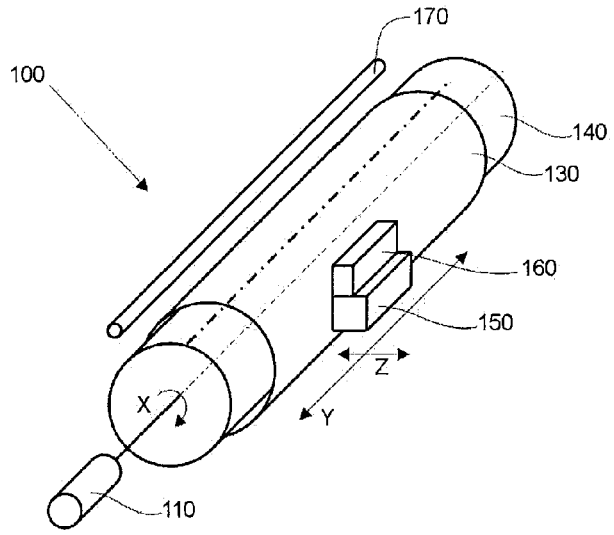
FIG. 1 shows a preferred embodiment of an apparatus for printing a flexographic printing master on a cylindrical sleeve.

In a method of preparing a flexographic printing master according to a preferred embodiment of the present invention an optional elastomeric floor (500), an optional mesa relief (600) and an image relief (700) are applied in this order on a flexographic printing support (1) by applying and curing fluid droplets thereby building up a plurality of layers of fluid on top of each other characterized in that each fluid droplet applied is at least partially cured before an adjacent fluid droplet is subsequently applied, with the exception that a fluid droplet applied during building up at least one layer of fluid is not cured before an adjacent fluid droplet of the same layer is subsequently applied.

From 2D image to 3D relief

The image to be printed can be any digital image represented as a raster bitmap. A typical image comprises multiple objects such as photographs, graphic objects and text objects. These objects are usually represented using a page description language and are rendered into a digital image by a raster image processor (RIP) such as made available by the company Adobe Systems Incorporated. The image can be monochrome or coloured. In the latter case the colour image is first separated into a set of ink separations that correspond with a set of corresponding printing inks.

Halftoning refers to an image processing technique which enables images having multiple densities to be rendered with a system having restricted density resolution. For example, a digital image that has pixels with a density resolution of 8 bits (256 shades) has to be rendered on a binary printing system having only two shades of density corresponding with ink or no ink. Halftoning can be AM (amplitude modulation), FM (frequency modulation) or XM (hybrid halftoning).

The two dimensional (2D) image to be printed with the flexographic printing master has to be converted into a three dimensional (3D) relief image that in a preferred embodiment of the present invention has to be printed on a flexographic support by inkjet. The 2D image to be printed corresponds in fact with the top layer or printing surface of the relief image. This top layer however has to be supported by the other layers forming the relief.

EP-A 1437882 teaches an image processing method for creating such a 3D relief image starting from the 2D image to be printed. A binary halftoned digital image represents the printing surface or top layer of the relief image. A topographic operator, such as a circular symmetric smoothing filter, is then applied on this binary halftoned image resulting in a contone image of which the densities represent the heights of a relief print master. The contone image is then conceptually sliced to obtain intermediate binary layers which, when printed on top of each other, form a 3D printing master. The effect of the smoothing filter is that around each pixel in an upper intermediate layer a circle of identical pixels is replicated in a lower intermediate layer. As a result, every lower intermediate layer always entirely supports any upper intermediate layer.

A possible disadvantage with the image processing technique disclosed in EP-A 1437882 is that it requires many computations. In EP-A 2199065 an image processing technique, also for creating a 3D printing master starting from a binary halftoned digital image, is disclosed which requires less computations. The method takes advantage of the observation that the exact shape of the intermediate layers for creating a 3D print master is not very important as long as the condition is fulfilled that every lower intermediate layer supports the higher intermediate layers.

Printing the 3D Relief on a Support

Once the 3D relief has been calculated, it has to be physically reconstructed by a 3D printing apparatus on a flexographic support. For example, the inkjet printing method as disclosed in EP-A 1428666 can be used to print the 3D relief. In this method a flexographic printing master is formed by applying subsequently on a flexographic support at least two layers of polymerisable fluid with an inkjet printer. In this inkjet method, a previously applied layer is at least partially cured before applying a subsequent layer.

FIG. 1 shows a preferred embodiment of an apparatus 100 for printing a flexographic printing master on a cylindrical sleeve 130. 140 is a rotating drum that is driven by a motor 110. A printhead 160 moves in a slow scan direction Y parallel with the axis of the drum at a linear velocity that is coupled to the rotational speed X of the drum. The printhead jets droplets of a polymerisable fluid onto a removable sleeve 130 that is mounted on the drum 140. These droplets are gradually cured by a curing source 150 that moves along with the printhead and provides local curing. When the flexographic printing master has been printed, the curing source 170 provides an optional and final curing step that determines the final physical characteristics of the flexographic printing master. It is however also possible to use only one curing source, for example the curing source 170. The location of this curing source 170 with respect to the printhead 160 and the rotational speed of the rotating drum 140 then determine the time between applying and curing the fluid droplets.

The 3D image representing the relief to be printed can thus be represented in X, Y and Z dimensions, whereby the X dimension corresponds with a fast scan orientation of a printing device, the Y dimension with a slow scan orientation and the Z dimension with the orientation of the relief features of the print master. The 3D image can be subdivided into a top layer, which corresponds with the image to be printed with the flexographic printing master, and supporting intermediate layers parallel to the X and Y dimensions.

The volume, speed and direction of fluid droplets ejected by the nozzles of an inkjet printhead may slightly vary between individual nozzles. It is well known in 2D inkjet printing that in absence of any compensating measures, such as shingling and interlacing techniques, this may lead to image quality artifacts such as banding and streaking which are correlated with differences between individual nozzles.

Such image quality artifacts may also appear in 3D inkjet printing.

To minimize such quality artifacts, the flexographic 3D image is preferably formed in accordance with the method disclosed in the EP-A 2199066. With this method, the layers making up the relief image are printed in such a way that at least two adjacent pixels in the Z dimension are printed with different nozzles. This achieves the effect that image quality artifacts correlated to a specific nozzle are spatially diffused in the Z dimension. The image quality artifacts related to a specific nozzle are also decorrelated in the X and Y dimensions by avoiding that neighbouring pixels along the X and Y dimensions are printed by the same nozzle.

Figure 2:
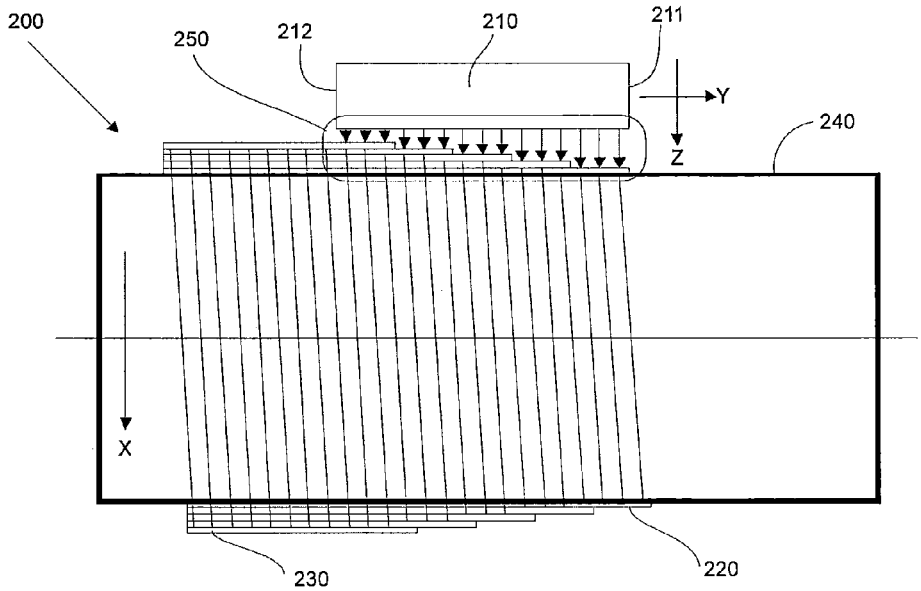
FIG. 2 shows a different view of a preferred embodiment of an apparatus for printing a flexographic printing master on a cylindrical sleeve showing the simultaneously printing of several fluid layers.

According to a preferred embodiment, multiple layers of the relief image are simultaneously printed by different sets of nozzles of the same printhead. For example, fluid droplets of a lower intermediate layer are printed by a first set of nozzles at a first location of the printing master and are at least partially cured. At the same time, fluid droplets of an upper intermediate layer are printed on top of already printed and at least partially cured droplets of the lower intermediate layer by a second set of nozzles of the same printhead at a second location. FIG. 2 shows a different view of a preferred embodiment of an apparatus (200) for printing a flexographic printing master on a cylindrical sleeve showing the simultaneously printing of several fluid layers. FIG. 2 demonstrates that, as the printhead 210 moves from left to right in the direction Y, droplets 250 are jetted onto the sleeve 240, whereby the "leading" part 211 of the printhead 210 prints droplets that belong to a lower layer 220, whereas the "trailing" part 212 of the printhead 210 prints droplets of an upper layer 230.

Figure 5:
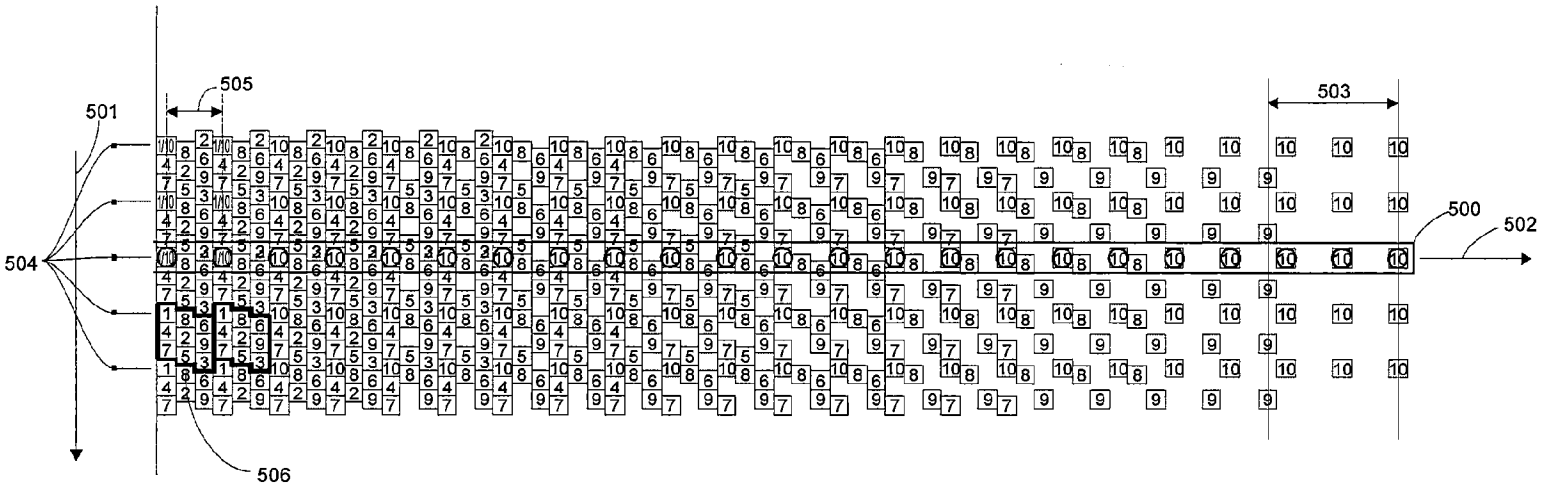
FIG. 5 shows how multiple layers are printed on a rotating sleeve during a single pass.

FIG. 5 is based on the upper part of FIG. 13J of EP-A 2199066. It shows a portion of the pixel positions on a drum upon which inkjet droplets are jetted by a printhead 500 according to a preferred embodiment of the invention that is disclosed in this document. The arrow 501 indicates the movement of the printhead in the fast scan direction relative to the drum. The arrow 502 indicates the direction of the slow scan direction of the printhead relative to the drum. The distance 503 corresponds with the slowScanPitch, i.e. the distance that the printhead travels in the slowscan direction during one revolution of the drum. The tickmarks 504 correspond with positions in the fast scan direction at which the printhead 500 can eject droplets within a specific single revolution. The numbers in FIG. 5 indicate the positions at which during a given revolution the printhead has deposited droplets. For example, the pixels indicated with "1" correspond with the positions where a droplet was ejected during a first revolution, whereas the pixels indicated with "2" correspond with the positions where a droplet was ejected during a second revolution. Because of the relationship between the firing frequency, the rotational speed of the drum, the slowScanPitch and the nozzlepitch of the printhead 500, a pattern 506 of 3 by 3 pixels within a layer is filled up after exactly nine revolutions. During a tenth revolution, a first pixel position of such a filled up pattern receives a first droplet of a second layer. The study of FIG. 5 teaches that different nozzles of the same printhead are jetting droplets on different layers. For example, on the right hand side the first droplets are printed onto pixel positions of the lowest layer, whereas on the left hand side, the first droplets are already jetted onto pixel positions of the second layer. In the general case different nozzles of the same printhead may print simultaneously onto N different layers.

The droplets that are ejected during each revolution are partly cured by the curing source 150 (FIG. 1). The effect of this is that according to the preferred embodiment of the teachings of the application EP-A 2199066, a droplet that is jetted onto the drum never touches a droplet that has not received partial curing.

Elastomeric Floor

Before applying the optional mesa relief (600) and the image relief (700), the flexographic support is optionally provided with one or more elastomeric layers, the latter making up the so-called elastomeric floor (500). To reduce the manufacturing time of a flexographic printing master and because resolution is not relevant while forming the elastomeric floor, the elastomeric floor, as well as the optional mesa relief, may be formed using fluid droplets having a drop volume which is at least 25% larger compared to the drop volume of the fluid droplets used while printing the image relief on the elastomeric floor or on the optional mesa relief. This may be achieved by using inkjet printer including a first and a second set of nozzles, wherein a nozzle diameter of a nozzle of the first set of nozzles is larger than a nozzle diameter of a nozzle of the second set nozzles. In making the printing relief on the flexographic printing support, the first set of nozzles having a larger nozzle diameter is used for printing the elastomeric floor and the optional mesa relief and the second set of nozzles is used for printing the image relief.

According to one preferred embodiment of the present invention, the elastomeric floor is applied by the inkjet method defined below together with an optional mesa relief and the image relief.

According to another preferred embodiment of the invention, the elastomeric floor may be applied by other coating techniques whereupon, after partially or fully curing the layers, the optional mesa relief and the image relief are applied by inkjet. Such a method is disclosed in EP-A 2033778. WO2008/034810 and WO2010/003921 disclose a coating method and coating device with which sleeves are provided with one or more elastomeric layers. As the coating device has a limited floor space it is a preferred coating device to be used in combination with a preferred embodiment of the present invention.

The height of an elastomeric floor (500) applied on a flexographic support (1) is preferably between 0.3 mm and 2 mm.

Mesa Relief

A preferred method for forming a 3D relief of a flexographic printing master is disclosed in EP-A 2199082. In this method the relief includes a so-called "mesa relief" as shown by the flexographic printing master in FIG. 3. The printing master in FIG. 3 comprises a support (1) whereupon an elastomeric floor (500) is applied. On the elastomeric floor (500), the mesa relief (600) and the image relief (700) are applied. The mesa relief is only present in those parts of the flexographic printing master comprising image features such as text, graphics and halftone images. In extended areas where such image features are absent, there is no mesa relief. This makes it possible to minimize the amount of fluid necessary to form the flexographic relief. A mesa relief preferably has a height in a range from 50 μm to 1 mm, for example 0.5 mm.

The mesa relief in different image areas of the flexographic printing master has preferably the same height. However, it is not necessary that the height of the mesa relief is identical over the whole flexographic printing master.

The mesa relief is preferably applied on the support by the same inkjet apparatus that is used for applying the image relief. However, to increase the manufacturing speed of the flexographic printing master and because resolution is not that relevant for the mesa relief, it is preferred to use for printing the mesa relief fluid droplets having a drop volume which is at least 25% larger compared to the drop volume of the fluid droplets used for printing the image relief on the mesa relief. This may be achieved by using inkjet printer including a first and a second set of nozzles wherein a nozzle diameter of a nozzle of the first set of nozzles is larger than a nozzle diameter of a nozzle of the second set nozzles.

Image Relief

Figure 3:
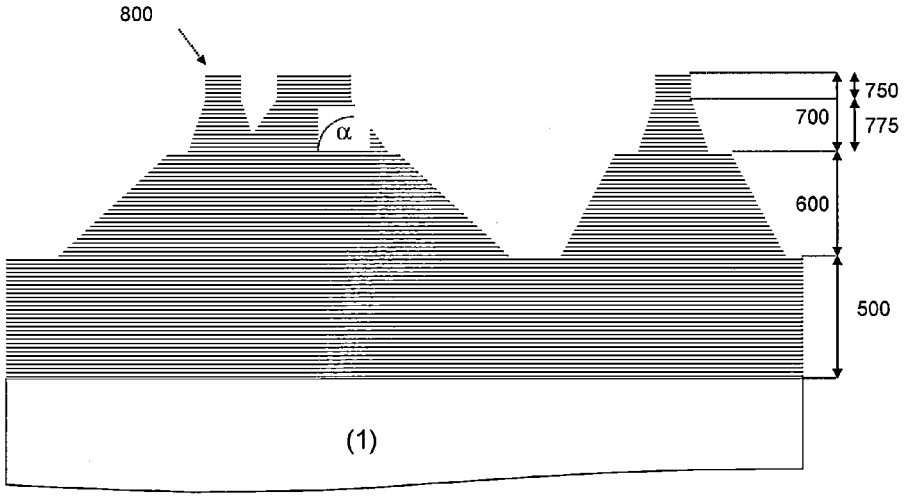
FIG. 3 shows a cross section of a preferred embodiment of the flexographic printing master wherein the relief image comprises a "top hat" profile.

The top layer (800) of the image relief corresponds with a halftone bitmap that defines the image to be printed by the printing master. The uppermost layers of the image relief are preferably identical in shape and size as the top layer, producing a vertical relief slope and defining a "top hat segment" (FIG. 3, 750). Such a top hat may have a height between 10 and 500 μm and preferably between 20 and 200 μm. The vertical relief slope of a top hat segment has the advantage that the printing surface remains constant during printing, even when pressure variations occur between the printing master and the anilox roller or between the print master and the printable substrate, or when the printing master wears off.

The intermediate layers, together forming a "sloped segment" (775), are preferably printed with a slope having an angle $\alpha$ that is less than 90 degrees. The angle can be between 25 and 75 degrees, preferably between 40 and 60 degrees, for example 50 degrees. The angle $\alpha$ can be controlled by controlling the height of the individual layers, their number and the difference in size between subsequent layers. Using a larger slope angle $\alpha$ (i.e. a steeper slope) has the advantage that small features on the print master will suffer less from pressure variations during printing.

Figure 4:
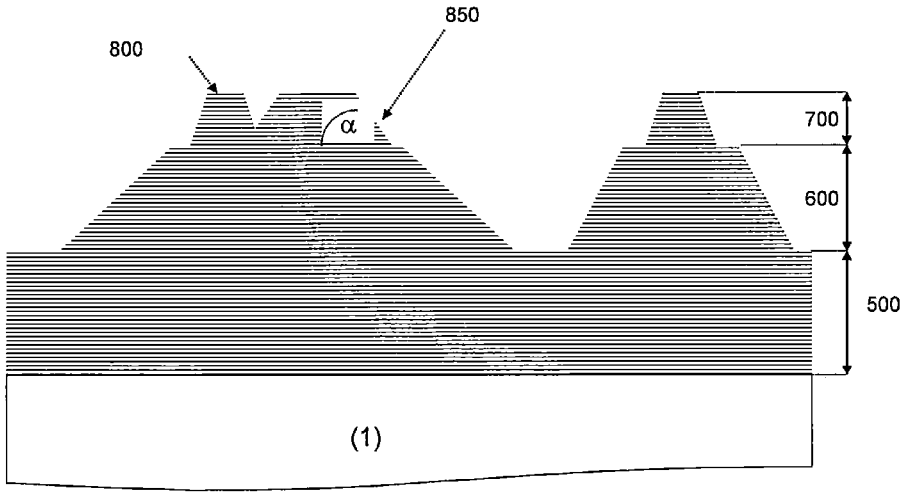
FIG. 4 shows a cross section of another preferred embodiment of the flexographic printing master wherein the relief image comprises a "regular" profile.

Alternatively however, it is also possible that the image relief has a "regular" profile, as shown in FIG. 4. Flexographic printing masters made by an analogue imaging technique such as a UV exposure through a mask have a relief having such a "regular" profile. A relief having a "top hat" segment can only be made by laser engraving or by inkjet printing. The relief having a "regular" profile as shown in FIG. 4 comprises an image relief (700) on an optional mesa relief (600) previously printed on an elastomeric floor (500) provided on a flexographic support (1). The shoulder (850) of the image relief (700) has a slope with a slope angle $\alpha$. This slope angle α can be optimized as described above. A disadvantage of such a flexographic printing master lies in the fact that when the upper layers of the image relief are worn down, dot gain occurs due to the sloped image shoulder.

When building up the 3D relief image using the printing method disclosed in EP-A 2199066, each fluid droplet applied for forming the 3D image is at least partially cured before an adjacent droplet of fluid of the same layer is subsequently applied. This prevents the droplets to spread or to coalesce. However, when using such a method, a problem may be a lack of smoothness of the applied layers of fluid. This problem may become more pronounced when larger drops of fluid are used, for example to prepare the elastomeric floor and/or the optional mesa relief to reduce the manufacturing time of the flexographic printing master.

Such lack of surface smoothness may be passed on from layer to layer forming the relief or may even be reinforced as more layers are jetted on top each other and may therefore result in an unsmooth surface of the relief, which can give rise to several printing artifacts such as a deficient reproduction of highlight dots or a deficient rendering of solids.

A possible solution to this problem has been suggested in EP-A 2199081 wherein after applying a relief image by inkjet, a grinding step is foreseen to ensure a flat surface. However, such an additional grinding step prolongs the time necessary to prepare the master and results in additional waste, thereby diminishing the overall sustainability of the method. Another solution was proposed in U.S. Pat. No. 6,520,084 wherein the relief image is grown in inverted orientation on a substrate to ensure a smooth surface of the relief image. However, the separation of the relief image from the substrate is an additional step and removable filler material is needed to support the inverted image relief.

It has now been found that the smoothness of the top surface, i.e. the print surface, can be improved when a fluid droplet applied during building up at least one layer of fluid is not cured before an adjacent fluid droplet of the same layer is subsequently applied. The best results are obtained when all fluid droplets forming the layer are not cured before an adjacent fluid droplet of the same layer is subsequently applied. However, satisfactory results are also obtained when at least 75%, more preferably at least 90%, most preferably at least 95% of the total amount of fluid droplets forming the layer are not cured before an adjacent fluid droplet of the same layer is subsequently applied. Preferably, the fluid droplets that are not cured are homogeneously distributed over the entire layer.

For a definition of the terms partially cured and not cured, see below in the section curing.

In principle, the layer wherein a fluid droplet is not cured before an adjacent droplet is subsequently applied may be located anywhere in the z dimension of the flexographic relief image, i.e. in the elastomeric floor, the optional mesa relief and the image relief. However, when fluid droplets with a higher drop volume are used to make the elastomeric floor and/or the optional mesa relief as compared to the fluid droplets that are used to form the image relief, it is preferred that the layer is the upper most layer of the elastomeric floor and/or the optional mesa relief. The layer may also be the top layer of the image relief, i.e. forming the print surface of the flexographic image.

More than one of the layers, for example two, three, four or more than five of the layers, wherein a fluid droplet is not cured before an adjacent droplet is subsequently applied may also be applied. Such layers may be applied on top of each other or they may be applied individually throughout the flexographic relief image, for example the upper most layer of the elastomeric floor and the upper most layer of the optional mesa relief. According to a particular preferred embodiment of the method according to the present invention, such layers are preferably the upper most layer of the elastomeric floor and the upper most layer of the mesa relief, or these layers are preferably the upper most layer of the mesa relief and the upper most layer of the image relief, or these layers are the upper most layer of the elastomeric floor, the uppermost layer of the mesa relief and the upper most layer of the image relief.

As the flexographic printing master preferably comprises more than 20 layers, it follows that for almost all layers each fluid droplet applied is at least partially cured before an adjacent fluid droplet is subsequently applied, with the exception of preferably 1, 2 or 3 layers wherein a fluid droplet is not cured before an adjacent fluid droplet of the same layer is subsequently applied.

According to yet another preferred embodiment, the layer may be a uniform layer applied on top of the flexographic image, i.e. covering both the printing and the non-printing areas.

The composition of all layers applied by inkjet may be the same or different. For example, the composition of the curable fluid used to apply the floor and/or mesa relief may be the same or different to the composition of the curable fluid used to apply to image relief. Also, the composition of the curable fluid used to apply the layers wherein a fluid droplet is not cured before an adjacent droplet is subsequently applied may be the same or different to the composition of the fluid droplets used to apply the other layers wherein a fluid droplet is at least partially cured before an adjacent droplet is subsequently applied. For example, the fluids used to apply the layers wherein a fluid droplet is not cured before an adjacent droplet is subsequently applied may be optimized to improve the coalescence between neighbouring droplets or to improve the spreading of the applied droplets, in order to further improve the flatness or evenness of the printing surface of the flexographic master.

It is believed that adjacent fluid droplets of the same layer which are not cured may at least partially coalesce. When all fluid droplets forming a layer coalesce, a homogeneous layer of fluid is formed. When such a homogeneous layer of fluid is then cured, a smoother surface is obtained as compared with the situation where no substantial coalescence of the drops of fluid occurs.

Flexographic Printing Support

Two forms of flexographic printing supports may be used: a sheet form and a cylindrical form, the latter commonly referred to as a sleeve. If the print master is created as a sheet form on a flatbed inkjet device, the mounting of the sheet form on a print cylinder may introduce mechanical distortions resulting in so-called anamorphic distortion in the printed image. Such a distortion may be compensated by an anamorphic pre-compensation in an image processing step prior to halftoning. Creating the print master directly on a sheet form mounted on a print cylinder or directly on a sleeve avoids the problem of geometric distortion altogether.

Using a sleeve as support provides improved registration accuracy and faster change over time on press. Furthermore, sleeves may be well-suited for mounting on an inkjet printer having a rotating drum, as shown in FIG. 3. Seamless sleeves have applications in flexographic printing of continuous designs such as in wallpaper, decoration, gift wrapping paper and packaging.

The term "flexographic printing support", often encompasses two types of support:

- a support without elastomeric layers on its surface; and
- a support with one or more elastomeric layers on its surface.

These one or more elastomeric layers form the so-called elastomeric floor.

In a preferred embodiment of the method of the present invention, the flexographic printing support referred to is a support, preferably a sleeve, without one or more elastomeric layers forming an elastomeric floor. Such a sleeve is also referred to as a basic sleeve or a sleeve base. Basic sleeves typically consist of composites, such as epoxy or polyester resins reinforced with glass fibre or carbon fibre mesh. Metals, such as steel, aluminium, copper and nickel, and hard polyurethane surfaces (e.g. durometer 75 Shore D) can also be used. The basic sleeve may be formed from a single layer or multiple layers of flexible material, as for example disclosed by US 2002466668. Flexible basic sleeves made of polymeric films can be transparent to ultraviolet radiation and thereby accommodate backflash exposure for building a floor in the cylindrical printing element. Multiple layered basic sleeves may include an adhesive layer or tape between the layers of flexible material. Preferred is a multiple layered basic sleeve as disclosed in U.S. Pat. No. 5,301,610. The basic sleeve may also be made of non-transparent, actinic radiation blocking materials, such as nickel or glass epoxy. The basic sleeve typically has a thickness from 0.1 to 1.5 mm for thin sleeves and from 2 mm to as high as 100 mm for other sleeves. For thick sleeves often combinations of a hard polyurethane surface with a low-density polyurethane foam as an intermediate layer combined with a fiberglass reinforced composite core are used as well as sleeves with a highly compressible surface present on a sleeve base. Depending upon the specific application, sleeve bases may be conical or cylindrical. Cylindrical sleeve bases are used primarily in flexographic printing.

The basic sleeve or flexographic printing sleeve is stabilized by fitting it over a steel roll core known as an air mandrel or air cylinder. Air mandrels are hollow steel cores which can be pressurized with compressed air through a threaded inlet in the end plate wall. Small holes drilled in the cylindrical wall serve as air outlets. The introduction of air under high pressure permits to float the sleeve into position over an air cushion. Certain thin sleeves are also expanded slightly by the compressed air application, thereby facilitating the gliding movement of the sleeve over the roll core. Foamed adapter or bridge sleeves are used to "bridge" the difference in diameter between the air-cylinder and a flexographic printing sleeve containing the printing relief. The diameter of a sleeve depends upon the required repeat length of the printing job.

Method of Applying an Elastomeric Floor on a Sleeve

According to another preferred embodiment of the present invention a basic sleeve provided with an elastomeric floor is prepared by applying and curing fluid droplets thereby building up a plurality of layers of fluid on top of each other so as to form the elastomeric floor characterized in that each fluid droplet applied is at least partially cured before an adjacent fluid droplet is subsequently applied, with the exception that a fluid droplet applied during building up at least one layer of fluid is not cured before an adjacent fluid droplet of the same layer is subsequently applied. Preferably, the at least one layer is the upper most layer of the elastomeric floor. With this method, an elastomeric floor is obtained with a smooth surface, even when fluid droplets having a large drop volume are used.

Such a sleeve provided with the elastomeric floor can then be further used to make a flexographic printing master by applying an optional mesa relief and an image relief by inkjet.

Apparatus for Creating the Flexographic Printing Master

Various preferred embodiments of an apparatus for creating the flexographic printing master by inkjet printing may be used. In principle a flat bed printing device may be used, however, a drum based printing device is preferred. A particularly preferred drum based printing device using a sleeve body as flexographic support is shown in FIG. 1 and has been discussed in detail above.

Printhead

The inkjet printer includes any device capable of coating a surface by breaking up a radiation curable fluid into small droplets which are then directed onto the surface. In the most preferred embodiment the radiation curable fluids are jetted by one or more printing heads ejecting small droplets in a controlled manner through nozzles onto a flexographic printing support, which is moving relative to the printing head(s). A preferred printing head for the inkjet printing system is a piezoelectric head. Piezoelectric inkjet printing is based on the movement of a piezoelectric ceramic transducer when a voltage is applied thereto. The application of a voltage changes the shape of the piezoelectric ceramic transducer in the printing head creating a void, which is then filled with radiation curable fluid. When the voltage is again removed, the ceramic returns to its original shape, ejecting a drop of fluid from the print head. However the inkjet printing method is not restricted to piezoelectric inkjet printing. Other inkjet printing heads can be used and include various types, such as a continuous type and thermal, electrostatic and acoustic drop on demand types. At high printing speeds, the radiation curable fluids must be ejected readily from the printing heads, which puts a number of constraints on the physical properties of the fluid, e.g. a low viscosity at the jetting temperature, which may vary from 25° C. to 110° C. and a surface energy such that the printing head nozzle can form the necessary small droplets.

An example of a printhead according to a preferred embodiment of the current invention is capable to eject droplets having a volume between 0.1 and 100 picoliter (pl) and preferably between 1 and 30 pl. Even more preferably the droplet volume is in a range between 1 pl and 8 pl. Even more preferably the droplet volume is only 2 or 3 pl.

Curing

For all layers of the relief image, except the at least one layer, immediately after the deposition of fluid droplet by the printhead the fluid droplet are exposed by a curing source. This provides immobilization and prevents the droplets to run out, which would deteriorate the quality of the print master. Such curing of applied fluid drops is often referred to as "pinning".

Curing can be "partial" or "full". The terms "partial curing" and "full curing" refer to the degree of curing, i.e. the percentage of converted functional groups, and may be determined by, for example, RT-FTIR (Real-Time Fourier Transform Infra-Red Spectroscopy) which is a method well known to the one skilled in the art of curable formulations. Partial curing is defined as a degree of curing wherein at least 5%, preferably 10%, of the functional groups in the coated formulation or the fluid droplet is converted. Full curing is defined as a degree of curing wherein the increase in the percentage of converted functional groups with increased exposure to radiation (time and/or dose) is negligible. Full curing corresponds with a conversion percentage that is within 10%, preferably 5%, from the maximum conversion percentage. The maximum conversion percentage is typically determined by the horizontal asymptote in a graph representing the percentage conversion versus curing energy or curing time. When in the present application the term "no curing" is used, this means that less than 5%, preferably less than 2.5%, most preferably less than 1%, of the functional groups in the coated formulation or the fluid droplet is converted. In the method according to a preferred embodiment of the present invention, applied fluid droplets which are not cured are allowed to spread or coalesce with adjacent applied fluid droplets. Radiation curable fluids are cured by exposing them to actinic radiation, e.g. by UV curing, by thermal curing and/or by electron beam curing. Preferably the curing process is performed by UV radiation.

The curing source may be arranged in combination with the inkjet printhead, travelling therewith so that the curable fluid is exposed to curing radiation very shortly after having been jetted (see FIG. 1, curing source 150). It may be difficult to provide a small enough radiation source connected to and travelling with the print head. Therefore, a static fixed radiation source may be employed, e.g. a source of UV-light, which is then connected to the printhead by a flexible radiation conductor such as a fibre optic bundle or an internally reflective flexible tube.

Alternatively, a source of radiation arranged not to move with the print head, may be an elongated radiation source extending transversely across the flexographic printing support surface to be cured and parallel with the slow scan direction of the print head (see FIG. 1, curing source 170). With such an arrangement, each applied fluid droplet is cured when it passes beneath the curing source 170. The time between jetting and curing depends on the distance between the printhead and the curing source 170 and the rotational speed of the rotating drum 140.

A combination of both curing sources 150 and 170 can also be used as depicted in FIG. 1.

Any UV light source, as long as part of the emitted light can be absorbed by the photo-initiator or photo-initiator system of the fluid droplets, may be employed as a radiation source, such as, a high or low pressure mercury lamp, a cold cathode tube, a black light, an ultraviolet LED, an ultraviolet laser, and a flash light.

For curing the inkjet printed radiation curable fluid, the imaging apparatus preferably has a plurality of UV light emitting diodes. The advantage of using UV LEDs is that it allows a more compact design of the imaging apparatus.

UV radiation is generally classified as UV-A, UV-B, and UV-C as follows:

UV-A: 400 nm to 320 nm

UV-B: 320 nm to 290 nm

UV-C: 290 nm to 100 nm

The most important parameters when selecting a curing source are the spectrum and the intensity of the UV-light. Both parameters affect the speed of the curing. Short wavelength UV radiation, such as UV-C radiation, has poor penetration and enables to cure droplets primarily on the outside. A typical UV-C light source is low pressure mercury vapour electrical discharge bulb. Such a source has a wide spectral distribution of energy, but with a strong peak in the short wavelength region of the UV spectrum. Long wavelength UV radiation, such as UV-A radiation, has better penetration properties. A typical UV-A source is a medium or high pressure mercury vapour electrical discharge bulb. Recently UV-LEDS have become commercially available which also emit in the UV-A spectrum and that have the potential to replace gas discharge bulb UV sources. By doping the mercury gas in discharge bulb with iron or gallium, an emission can be obtained that covers both the UV-A and UV-C spectrum. The intensity of a curing source has a direct effect on curing speed. A high intensity results in higher curing speeds.

The curing speed should be sufficiently high to avoid oxygen inhibition of free radicals that propagate during curing. Such inhibition not only decreases curing speed, but also negatively affects the conversion ratio of monomer into polymer. To minimize such oxygen inhibition, the imaging apparatus preferably includes one or more oxygen depletion units. The oxygen depletion units place a blanket of nitrogen or other relatively inert gas (e.g. $CO_2$), with adjustable position and adjustable inert gas concentration, in order to reduce the oxygen concentration in the curing environment. Residual oxygen levels are usually maintained as low as 200 ppm, but are generally in the range of 200 ppm to 1200 ppm.

Another way to prevent oxygen inhibition is the performance of a low intensity pre-exposure before the actual curing.

A partially cured fluid droplet is solidified but still contains residual monomer. This approach improves the adhesion properties between the layers that are subsequently printed on top of each other. Partial intermediate curing is possible with UV-C radiation, UV-A radiation or with broad spectrum UV radiation. As mentioned above, UV-C radiation cures the outer skin of a fluid droplet and therefore a UV-C partially cured fluid droplet will have a reduced availability of monomer in the outer skin and this negatively affects the adhesion between neighbouring layers of the relief image. It is therefore preferred to perform the partial curing with UV-A radiation.

A final post curing however is often realized with UV-C light or with broad spectrum UV light. Final curing with UV-C light has the property that the outside skin of the print master is fully hardened.

Thermal curing can be performed image-wise e.g. by use of a thermal head or a laser beam. If a laser beam is used, then preferably an infrared laser is used in combination with an infrared dye in the curable fluid. When electron beams are employed, the exposure amount of the electron beam is preferably controlled to be in the range of 0.1-20 Mrad.

It is important to avoid that light—even stray light—from a curing source reaches the nozzles of a printhead, because this would cause the fluid to polymerize in the nozzles, resulting in "nozzle failure" or "clogging". For this reason, a curing source and a printhead should be sufficiently spaced apart, or a screen should be placed in between both.

Radiation Curable Fluids

The radiation curable fluid is preferably curable by actinic radiation which can be UV light, IR light or visible light. Preferably the radiation curable fluid is a UV curable fluid. The radiation curable fluid preferably contains at least a photo-initiator and a polymerizable compound. The polymerizable compound can be a monofunctional or polyfunctional monomer, oligomer or pre-polymer or a combination thereof. The radiation curable fluid may be a cationically curable fluid but is preferably a free radical curable fluid. The free radical curable fluid preferably contains substantially acrylates rather than methacrylates for obtaining a high flexibility of the applied layer. Also the functionality of the polymerizable compound plays an important role in the flexibility of the applied layer. Preferably a substantial amount of monofunctional monomers and oligomers are used.

In a preferred embodiment of the present invention, the radiation curable fluid includes a photoinitiator and a polymerizable compound selected from the group consisting of lauryl acrylate, polyethyleneglycol diacrylate, polyethylene glycol dimethacrylate, 2-(2-ethoxyethoxy)ethyl acrylate, 2-phenoxyethyl acrylate, 2-phenoxyethyl methacrylate, propoxylated neopentylglycol diacrylate, alkoxylated hexanediol diacrylate, isobornylacrylate, isodecyl acrylate, hexane diol diacrylate, caprolacton acrylate and urethane acrylates. In a more preferred embodiment of the present invention, the radiation curable fluid includes an aliphatic urethane acrylate. Aromatic type urethane acrylates are less preferred. In an even more preferred embodiment, the urethane acrylate is a urethane monoacrylate. Commercial examples include GENOMER™ 1122 and EBECRYL™ 1039. The flexibility of a given urethane acrylate can be enhanced by increasing the linear molecular weight between crosslinks. Polyether type urethane acrylates are for flexibility also more preferred than polyester type urethane acrylates. Preferably the radiation curable fluid does not include amine modified polyether acrylates which reduce the flexibility of the cured layer. An elastomer or a plasticizer is preferably present in the radiation curable fluid for improving desired flexographic properties such as flexibility and elongation at break.

The radiation curable fluid may contain a polymerization inhibitor to restrain polymerization by heat or actinic radiation.

The radiation curable fluid may contain at least one surfactant for controlling the spreading of the fluid. The radiation curable fluid may further contain at least one colorant for increasing contrast of the image on the flexographic printing master.

The radiation curable fluid may further contain at least one acid functionalized monomer or oligomer. The radiation curable fluid preferably has a viscosity at a shear rate of 100 $s^{-1}$and at a temperature between 15 and 70° C. of not more than 100 mPa·s, preferably less than 50 mPa·s, and more preferably less than 15 mPa·s.

Monofunctional Monomers

Any polymerizable monofunctional monomer commonly known in the art may be employed. Particular preferred polymerizable monofunctional monomers are disclosed in paragraphs [0054] to [0058] of EP-A 1637926 A. Two or more monofunctional monomers can be used in combination. The monofunctional monomer preferably has a viscosity smaller than 30 mPa·s at a shear rate of 100 $s^{-1}$ and at a temperature between 15 and 70° C.

Polyfunctional Monomers and Oligomers

Any polymerizable polyfunctional monomer and oligomer commonly known in the art may be employed. Particular preferred polyfunctional monomers and oligomers are disclosed in paragraphs [0059] to [0063] of EP-A 1637926. Two or more polyfunctional monomers and/or oligomers can be used in combination. The polyfunctional monomer or oligomer preferably has a viscosity larger than 50 mPa·s at a shear rate of 100 $s^{-1}$ and at a temperature between 15 and 70° C.

Acid Functionalized Monomers and Oligomers

Any polymerizable acid functionalized monomer and oligomer commonly known in the art may be employed. Particular preferred acid functionalized monomers and oligomers are disclosed in paragraphs [0066] to [0070] of EP-A 1637926.

Photo-Initiators

The photo-initiator, upon absorption of actinic radiation, preferably UV-radiation, forms free radicals or cations, i.e. high-energy species inducing polymerization and crosslinking of the monomers and oligomers in the radiation curable fluid.

A preferred amount of photo-initiator is 1 to 10% by weight, more preferably 1 to 7% by weight, of the total radiation curable fluid weight. A combination of two or more photo-initiators may be used. A photo-initiator system, comprising a photo-initiator and a co-initiator, may also be used. A suitable photo-initiator system comprises a photo-initiator, which upon absorption of actinic radiation forms free radicals by hydrogen abstraction or electron extraction from a second compound, the co-initiator. The co-initiator becomes the actual initiating free radical.

Irradiation with actinic radiation may be realized in two steps, each step using actinic radiation having a different wavelength and/or intensity. In such cases it is preferred to use 2 types of photo-initiators, chosen in function of the different actinic radiation used. Suitable photo-initiators are disclosed in paragraphs [0077] to [0079] of EP-A 1637926.

Inhibitors

Suitable polymerization inhibitors include phenol type antioxidants, hindered amine light stabilizers, phosphor type antioxidants, hydroquinone monomethyl ether commonly used in (meth)acrylate monomers, and hydroquinone, methylhydroquinone, t-butylcatechol, pyrogallol may also be used. Of these, a phenol compound having a double bond in molecules derived from acrylic acid is particularly preferred due to its having a polymerization-restraining effect even when heated in a closed, oxygen-free environment. Suitable inhibitors are, for example, SUMILIZER™ GA-80, SUMILIZER™ GM and SUMILIZER™ GS produced by Sumitomo Chemical Co., Ltd.

Since excessive addition of these polymerization inhibitors will lower the sensitivity to curing of the radiation curable fluid, it is preferred that the amount capable of preventing polymerization be determined prior to blending. The amount of a polymerization inhibitor is generally between 200 and 20,000 ppm of the total radiation curable fluid weight.

Oxygen Inhibition

Suitable combinations of compounds which decrease oxygen polymerization inhibition with radical polymerization inhibitors are: 2-benzyl-2-dimethylamino-1-(4-morpholinophenyl)-butane-1 and 1-hydroxy-cyclohexyl-phenyl-ketone; 1-hydroxy-cyclohexyl-phenyl-ketone and benzophenone; 2-methyl-1[4-(methylthio)phenyl]-2-morpholinopropane-1-on and diethylthioxanthone or isopropylthioxanthone; and benzophenone and acrylate derivatives having a tertiary amino group, and addition of tertiary amines. An amine compound is commonly employed to decrease an oxygen polymerization inhibition or to increase sensitivity. However, when an amine compound is used in combination with a high acid value compound, the storage stability at high temperature tends to be decreased. Therefore, specifically, the use of an amine compound with a high acid value compound in ink-jet printing should be avoided. Synergist additives may be used to improve the curing quality and to diminish the influence of the oxygen inhibition. Such additives include, but are not limited to ACTILANE™ 800 and ACTILANE™ 725 available from AKZO NOBEL, EBECRYL™ P115 and EBECRYL™ 350 available from UCB CHEMICALS and CD 1012, CRAYNOR™ CN 386 (amine modified acrylate) and CRAYNOR™ CN 501 (amine modified ethoxylated trimethylolpropane triacrylate) available from CRAY VALLEY. The content of the synergist additive is in the range of 0 to 50% by weight, preferably in the range of 5 to 35% by weight, based on the total weight of the radiation curable fluid.

Plasticizers

Plasticizers are usually used to improve the plasticity or to reduce the hardness of adhesives, sealing compounds and coating compositions. Plasticizers are fluid or solid, generally inert organic substances of low vapour pressure. Suitable plasticizers are disclosed in paragraphs [0086] to [0089] of EP-A 1637926. The amount of plasticizer is preferably at least 5% by weight, more preferably at least 10% by weight, each based on the total weight of the radiation curable fluid. The plasticizers may have molecular weights up to 30,000 but are preferably fluids having molecular weights of less than 5,000.

Elastomers

The elastomer may be a single binder or a mixture of various binders. The elastomeric binder is an elastomeric copolymer of a conjugated diene-type monomer and a polyene monomer having at least two non-conjugated double bonds, or an elastomeric copolymer of a conjugated diene-type monomer, a polyene monomer having at least two non-conjugated double bonds and a vinyl monomer copolymerizable with these monomers. Preferred elastomers are disclosed in paragraphs [0092] and [0093] of EP-A 1637926.

Surfactants

The surfactant(s) may be anionic, cationic, non-ionic, or zwitter-ionic and are usually added in a total quantity below 20% by weight, more preferably in a total quantity below 10% by weight, each based on the total radiation curable fluid weight.

A fluorinated or silicone compound may be used as a surfactant, however, a potential drawback is bleed-out after image formation because the surfactant does not cross-link. It is therefore preferred to use a copolymerizable monomer having surface-active effects, for example, silicone-modified acrylates, silicone modified methacrylates, fluorinated acrylates, and fluorinated methacrylates.

Colorants

Colorants may be dyes or pigments or a combination thereof. Organic and/or inorganic pigments may be used.

Suitable dyes and pigments include those disclosed by ZOLLINGER, Heinrich, Color Chemistry: Syntheses, Properties, and Applications of Organic Dyes and Pigments,3rd edition, WILEY-VCH, 2001, ISBN 3906390233, page.550. Suitable pigments are disclosed in paragraphs [0098] to [0100] of EP-A 1637926. The pigment is present in the range of 0.01 to 10% by weight, preferably in the range of 0.1 to 5% by weight, each based on the total weight of radiation curable fluid.

Solvents

The radiation curable fluid preferably does not contain an evaporable component, but sometimes, it can be advantageous to incorporate an extremely small amount of a solvent to improve adhesion to the ink-receiver surface after UV curing. In this case, the added solvent may be any amount in the range of 0.1 to 10.0% by weight, preferably in the range of 0.1 to 5.0% by weight, each based on the total weight of radiation curable fluid.

Humectants

When a solvent is used in the radiation curable fluid, a humectant may be added to prevent the clogging of the nozzle, due to its ability to slow down the evaporation rate of radiation curable fluid. Suitable humectants are disclosed in paragraph [0105] of EP-A 1637926. A humectant is preferably added to the radiation curable fluid formulation in an amount of 0.01 to 20% by weight of the formulation, more preferably in an amount of 0.1 to 10% by weight of the formulation.

Biocides

Suitable biocides include sodium dehydroacetate, 2-phenoxyethanol, sodium benzoate, sodium pyridinethion-1-oxide, ethyl p-hydroxy-benzoate and 1,2-benzisothiazolin-3-one and salts thereof. A preferred biocide for the radiation curable fluid suitable for the method for manufacturing a flexographic printing master according to a preferred embodiment of the present invention, is PROXEL™ GXL available from ZENECA COLOURS.

A biocide is preferably added in an amount of 0.001 to 3% by weight, more preferably in an amount of 0.01 to 1.00% by weight, each based on radiation curable fluid.

Preparation of Radiation Curable Fluids

The radiation curable fluid may be prepared as known in the art by mixing or dispersing the ingredients together, optionally followed by milling, as described for example in paragraphs [0108] and [0109] of EP-A 1637926.

EXAMPLES

Materials

All materials used in the examples were readily available from standard sources such as Aldrich Chemical Co. (Belgium) and Acros (Belgium) unless otherwise specified.

- DPGDA is a dipropylene glycol diacrylate available from UCB
- Agfarad is a mixture of 4 wt. % p-methoxyphenol, 10 wt. % 2,6-di-tert-butyl-4-methylfenol and 3.6 wt. % Aluminium N-nitroso-phenylhydroxylamine (available from CUPFERRON AL) in DPGDA
- Ebecryl 1360 is a silicone hexa-acrylate available from Cytec
- SR506D is an isobornylacryate available from Sartomer
- Genomer 1122 is a low viscous monofunctional urethane acrylate(2-acrylic acid 2-(((acryl-amino)carbonyl)oxy) ethylester) from RAHN
- SR610 is a polyethylene glycol (600) diacrylate available from Sartomer
- Darocur TPO is a 2,4,6-Trimethylbenzoylphenyl-phosphineoxide from CIBA
- Santicizer 278 is a plasticizer available from MONSANTO
- Genocure EPD is a Ethyl-4-dimethyl-aminobenzoate available from RAHN
- Darocur ITX is an isopropylthioxanthone available from CIBA

Example 1

As flexographic support a subbed PET film having a thickness of 100 μm was used. The support was mounted on a drum. The rotation speed of the drum during printing was 30 cm/s. As curing source, a UV LED ((365 nm) array encompassing the full print width was used. The distance between the UV LED array and the drum was 2 cm, the distance between the UV LED array and the printhead approximately 8 cm. Taking into account the rotational speed of the drum this means that the time between applying a drop of fluid on the support or on previous applied layers of fluid and curing that drop of fluid was approximately 0.25 s. The energy output of the UV LEDs was 0.65 W/cm$^2$ (corresponding with a UV-LED power controller setting of 1.5 A). As printhead, an Agfa UPH printhead was used having 700 nozzles with a nozzle diameter of 25 μm resulting in a drop volume of 8 pl.

56 layers of ink were printed in one pass of the printhead during which the UV-LED array was active, resulting in a thickness of approximately 270 μm. The layers were printed in such a way that each applied drop of ink was at least partially cured before an adjacent drop of ink was subsequently applied (using the method as described on page 7 and 8 of the description and in EP-A 2199066).

Example 2

In example 2, on top of the 56 layers printed as in example 1, two additional layers, having the same composition as those of the 56 previous applied layers, were printed in one additional second pass of the printhead during which the UV-LED array was not active. Therefore, each drop of ink applied in these two layers was not cured before an adjacent drop of ink of the same layer was subsequently applied. As a result, adjacent applied drops of ink at least partially coalesced. 1 minute after completion of the second pass of the printhead, the UV-LED array was activated to cure the last two layers applied. The energy output of the UV-LEDs was 6 $W/cm^2$ (corresponding with a UV-LED power controller setting of 15 A).

Roughness measurements were carried out on both examples 1 and 2. The measurements were carried out in accordance with ISO4288 with a Dektak-8 stylus profiler, available from VEECO using a needle having a tip radius of 2.5 μm, a cone angle of 45° and a static measuring force of 5 mg. In Table 1, each value is an average of 10 measurements.

TABLE 1

| | Ra (um) | Rv (um) | Rp (um) | Rt (um) | Rz (um) |
|---|---|---|---|---|---|
| Ex. 1 (COMP) | 0.224 | −0.929 | 2.102 | 3.031 | 1.536 |
| Ex. 2 (INV) | 0.055 | −0.215 | 0.184 | 0.399 | 0.283 |

The viscosity of the ink (measured with a Brookfield DV-II viscosimeter at 45° C.) amounted to 10.80 mPa·s. The static surface tension, measured with a "Tensiometer K9" from Krüss was 28.90 mN/m.

The ink used had the composition as shown in Table 2.

TABLE 2

| Ingredient | Amount wt. % |
|---|---|
| SR506D | 42.2 |
| Genomer 1122 | 13.33 |
| SR610 | 17.76 |
| Santicizer 278 | 11.10 |
| Ebecryl 1360 | 0.04 |
| Agfarad | 0.70 |
| Genocure EPD | 5.00 |
| Darocur ITX | 5.00 |
| Darocur TPO | 4.90 |

It is clear from the roughness parameters shown in Table 1 that the printing surface of the inventive example 2 is significantly smoother than the printing surface of the comparative example 1.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is :

1. A method of preparing a flexographic printing master including a relief on a flexographic printing support, the method comprising:

building up a plurality of layers by applying and curing fluid droplets on a flexographic printing support, each of the fluid droplets being cured or partially cured before an adjacent one of the fluid droplets within a same layer of the plurality of layers is subsequently applied; and building up at least one layer of the plurality of layers by the steps of:

a) applying a fluid droplet;

b) applying a fluid droplet in the at least one layer adjacent to the fluid droplet applied in step a) without first curing or partially curing the fluid droplet applied in step a);

c) allowing the fluid droplet applied in step a) to at least partially coalesce with the fluid droplet applied in step b); and d) curing the fluid droplets at least partially coalesced in step c).

2. The method for preparing a flexographic printing master according to claim 1, wherein at least 75% of the fluid droplets applied during the build up of the at least one layer are not cured before the adjacent fluid droplet of the same layer is subsequently applied.

3. The method for preparing a flexographic printing master according to claim 1, wherein the relief includes a mesa relief and an image relief.

4. The method for preparing a flexographic printing master according to claim 3, wherein the at least one layer is an upper most layer of the mesa relief.

5. The method for preparing a flexographic printing master according to claim 3, wherein the at least one layer is an upper most layer of the image relief.

6. The method for preparing a flexographic printing master according to claim 1, wherein the fluid droplets are UV curable.

7. The method for preparing a flexographic printing master according to claim 1, wherein the flexographic printing support is a sleeve.

8. The method for preparing a flexographic printing master according to claim 1, wherein the flexographic printing support includes an elastomeric layer.

9. The method for preparing a flexographic printing master according to claim 8, wherein the flexographic printing support is a sleeve.

10. The method for preparing a flexographic printing master according to claim 1, wherein the relief includes a top hat segment.

11. The method for preparing a flexographic printing master according to claim 1, wherein the steps a), b), and c) are repeated at least once before performing step d).

12. The method for preparing a flexographic printing master according to claim 3, wherein the at least one layer built up by the steps a) to d) is an upper most layer of the mesa relief.

13. The method for preparing a flexographic printing master according to claim 1, wherein the at least one layer built up by the steps a) to d) is an upper most layer of the relief.

14. The method for preparing a flexographic printing master according to claim 1, wherein all of the fluid droplets applied during the build up of the at least one layer are not cured before the adjacent fluid droplet of the same layer is subsequently applied.

* * * * *